US010000837B2

(12) United States Patent
Weber et al.

(10) Patent No.: US 10,000,837 B2
(45) Date of Patent: Jun. 19, 2018

(54) METHODS AND APPARATUS FOR FORMING BULK METALLIC GLASS PARTS USING AN AMORPHOUS COATED MOLD TO REDUCE CRYSTALLIZATION

(71) Applicant: Apple Inc., Cupertino, CA (US)

(72) Inventors: Douglas J. Weber, Arcadia, CA (US); Kazuya Takagi, Tokyo (JP); Theodore A. Waniuk, Lake Forest, CA (US)

(73) Assignee: Apple Inc., Cupertino, CA (US)

( * ) Notice: Subject to any disclaimer, the term of this patent is extended or adjusted under 35 U.S.C. 154(b) by 155 days.

(21) Appl. No.: 14/811,594

(22) Filed: Jul. 28, 2015

(65) Prior Publication Data

US 2016/0024630 A1 Jan. 28, 2016

Related U.S. Application Data

(60) Provisional application No. 62/029,915, filed on Jul. 28, 2014.

(51) Int. Cl.
*C22F 1/14* (2006.01)
*C22C 1/00* (2006.01)
(Continued)

(52) U.S. Cl.
CPC ..... *C22F 1/14* (2013.01); *B22C 3/00* (2013.01); *C22C 1/002* (2013.01); *C22C 45/003* (2013.01)

(58) Field of Classification Search
CPC ..... C22F 1/14; C22F 1/002; C22F 45/003; B22C 3/00
See application file for complete search history.

(56) References Cited

U.S. PATENT DOCUMENTS 4,386,896 A 6/1983 Ray
5,288,344 A 2/1994 Peker et al.
(Continued)

FOREIGN PATENT DOCUMENTS

JP 2001-303218 10/2001
JP 2009-173964 5/2009
JP 2014058716 A * 4/2014

OTHER PUBLICATIONS

Shen et al., "Bulk Glassy $Co_{43}Fe_{20}Ta_{5.5}B_{31.5}$Alloy with High Glass-Forming Ability and Good Soft Magnetic Properties," *Materials Transactions*, vol. 42, No. 10 (2001) pp. 2136-2139.
(Continued)

*Primary Examiner* — Veronica F Faison
(74) *Attorney, Agent, or Firm* — Polsinelli PC

(57) ABSTRACT

Embodiments herein relate to methods and apparatuses for casting of BMG-containing parts. The surfaces of the mold that come into contact with the molten amorphous alloy comprise an amorphous material. In accordance with the disclosure, the mold may be coated with an amorphous material, e.g., to reduce, minimize, or eliminate crystallization of the molded BMG-containing part. The surfaces of the mold are coated, in certain aspects, so as to reduce or eliminate potential grain-boundary nucleation sites for BMG crystallization. The amorphous material may be selected based on the particular molten amorphous alloy to be cast, e.g., based on the wetting properties, the melting and cooling properties, etc.

19 Claims, 2 Drawing Sheets

(51) Int. Cl.
*C22C 45/00* (2006.01)
*B22C 3/00* (2006.01)

(56) References Cited

U.S. PATENT DOCUMENTS

| | | | | |
|---|---|---|---|---|
| 5,368,659 | A | 11/1994 | Peker et al. | |
| 5,576,884 | A | 11/1996 | Ise et al. | |
| 5,618,359 | A | 4/1997 | Lin et al. | |
| 5,647,921 | A | 7/1997 | Odagawa et al. | |
| 5,711,363 | A * | 1/1998 | Scruggs | B22D 17/00 164/113 |
| 5,735,975 | A | 4/1998 | Lin et al. | |
| 6,086,651 | A | 7/2000 | Mizushima | |
| 6,325,868 | B1 | 12/2001 | Kim et al. | |
| 6,749,700 | B2 | 6/2004 | Sunakawa et al. | |
| 7,575,040 | B2 | 8/2009 | Johnson | |
| 2001/0028245 | A1 | 10/2001 | Li et al. | |
| 2004/0046481 | A1 | 3/2004 | Takeuchi et al. | |
| 2006/0157164 | A1 | 7/2006 | Johnson et al. | |
| 2006/0254386 | A1 | 11/2006 | Inoue et al. | |
| 2007/0003782 | A1 | 1/2007 | Collier | |
| 2007/0079907 | A1 | 4/2007 | Johnson et al. | |
| 2007/0111119 | A1 | 5/2007 | Hu et al. | |
| 2007/0267111 | A1 | 11/2007 | Fleury et al. | |
| 2007/0290339 | A1 | 12/2007 | Suh et al. | |
| 2008/0118387 | A1 | 5/2008 | Demetriou et al. | |
| 2008/0185188 | A1 | 8/2008 | Blue et al. | |
| 2008/0209976 | A1 | 9/2008 | Deneuville | |
| 2009/0139858 | A1 | 6/2009 | Nakamura et al. | |
| 2009/0246549 | A1 | 10/2009 | Jang et al. | |
| 2010/0084052 | A1 | 4/2010 | Farmer et al. | |
| 2010/0230012 | A1 * | 9/2010 | Demetriou | C22C 1/002 148/403 |
| 2010/0300148 | A1 | 12/2010 | Demetriou et al. | |
| 2010/0310901 | A1 | 12/2010 | Making et al. | |
| 2011/0165339 | A1 | 7/2011 | Skoglund et al. | |
| 2012/0174976 | A1 | 7/2012 | Kim et al. | |
| 2012/0247948 | A1 | 10/2012 | Shin et al. | |
| 2012/0312061 | A1 * | 12/2012 | Pham | C22C 1/002 72/60 |
| 2012/0325051 | A1 | 12/2012 | Watson | |
| 2013/0139964 | A1 | 6/2013 | Hofmann et al. | |
| 2013/0309121 | A1 | 11/2013 | Prest et al. | |
| 2014/0007983 | A1 | 1/2014 | Prest et al. | |
| 2014/0334106 | A1 * | 11/2014 | Prest | C22C 45/00 361/718 |
| 2015/0202841 | A1 | 7/2015 | Verreault et al. | |
| 2015/0299825 | A1 | 10/2015 | Poole et al. | |
| 2015/0314566 | A1 | 11/2015 | Poole et al. | |
| 2015/0315678 | A1 | 11/2015 | Poole et al. | |
| 2015/0315687 | A1 | 11/2015 | Poole et al. | |

OTHER PUBLICATIONS

Inoue et al., "Bulk Amorphous Alloys with High Mechanical Strength and Good Soft Magnetic Properties in Pe-TM-B (TM=IV-VII Group Transition Metal) System," *Appl. Phys. Lett.*, vol. 71, (1997) pp. 464.

U.S. Appl. No. 14/667,191, filed Mar. 24, 2015, to Jong Hyun Na et al.

Hays et al., "Microstructure Controlled Shear Band Pattern Formation and Enhanced Plasticity of Bulk Metallic Glasses Containing in situ Formed Ductile Phase Dendrite Dispersions," *Physical Review Letters*, Mar. 2000, vol. 84, No. 13, pp. 2901-2904.

Conner et al., "Mechanical Properties of Tungsten and Steel Fiber Reinforced $Zr_{41.25}Ti_{13.75}Cu_{12.5}Ni_{10}Be_{22.5}$ Metallic Glass Matrix Composites," *Acta mater.*, 1998, vol. 46, No. 7, pp. 6089-6102.

Kato et al., "Relationship between thermal expansion coefficient and glass transition temperature in metallic glasses," *Scripta Materialia*, 2008, vol. 58, pp. 1106-1109.

Shackelford, James R. Alexander, William CRC Materials Science and Engineering Handbook, (2001), Taylor & Francis, (3rd Edition), Table 112.

* cited by examiner

METHODS AND APPARATUS FOR FORMING BULK METALLIC GLASS PARTS USING AN AMORPHOUS COATED MOLD TO REDUCE CRYSTALLIZATION

The application claims the benefit under 35 U.S.C. § 119(e) of U.S. Provisional Patent Application No. 62/029,915, entitled "Methods and Apparatus for Forming Bulk Metallic Glass Using an Amorphous Coated Mold to Reduce Crystallization," filed on Jul. 28, 2014, which is incorporated herein by reference in its entirety.

TECHNICAL FIELD

The disclosure is directed to methods and apparatus for forming bulk metallic glass parts.

BACKGROUND

Amorphous alloys have a combination of high strength, elasticity, corrosion resistance and processability from the molten state. Amorphous alloys are generally processed and formed by cooling a molten alloy from above the melting temperature of the crystalline phase (or the thermodynamic melting temperature) to below the "glass transition temperature" of the amorphous phase at "sufficiently fast" cooling rates, such that the nucleation and growth of alloy crystals is avoided. As such, the processing methods for amorphous alloys have always been concerned with quantifying the "sufficiently fast cooling rate", which is also referred to as "critical cooling rate", to ensure formation of the amorphous phase.

Conventional processes have not been suitable for forming amorphous alloys, and special casting processes such as melt spinning and planar flow casting are often used. For crystalline alloys having fast crystallization kinetics, extremely short times (on the order of $10^{-3}$ seconds or less) for heat extraction from the molten alloy are used to bypass crystallization. Such amorphous alloys are capable of forming only very thin amorphous foils and ribbons (order of 25 microns in thickness).

However, difficulties are still encountered during casting and molding of bulk metallic glasses ("BMGs"). As such, there is still a need for improved casting and molding techniques associated with BMGs.

SUMMARY

Described herein are methods and apparatuses for use in casting metallic glass-containing parts, wherein the surfaces of the mold that comes into contact with the molten alloy comprise an amorphous material.

In one aspect, the method of forming the metallic glass comprises placing a softened or molten metallic glass-forming alloy in contact with the surface of a mold, wherein said surface is amorphous;

cooling the metallic glass-forming alloy to form a metallic glass

In accordance with certain aspects, the mold surface may comprise an amorphous material, e.g., to reduce, minimize, or eliminate crystallization of the molded BMG-containing part. The amorphous material may be selected based on the particular molten amorphous alloy to be cast, e.g., based on the wetting properties, the melting and cooling properties, etc.

BRIEF DESCRIPTION OF FIGURES

Although the following figures and description illustrate specific embodiments and examples, the skilled artisan will appreciate that various changes and modifications may be made without departing from the spirit and scope of the disclosure.

DETAILED DESCRIPTION

The disclosure is directed to methods and apparatuses used to mold BMG parts, where the mold comprises an amorphous material at the mold surface in contact with a molten amorphous alloy. In various aspects, use of the amorphous material can reduce, minimize, or eliminate potential nucleation sites for alloy crystallization. As a result, crystallization of the molten amorphous alloy is reduced during processing. The terms "amorphous alloy" and "metallic glass" are used interchangeably herein.

Amorphous alloys differ from conventional crystalline alloys in that their atomic structure lack the typical long range ordered patterns of the atomic structure of conventional crystalline alloys. Metallic glasses typically have critical cooling rates as low as a few ° C./second, which allows the processing and forming of much larger bulk amorphous objects. Bulk-metallic glasses, or BMGs, are amorphous alloys having a critical rod diameter of at least 1 mm. As used herein, the "critical rod diameter" is the largest rod diameter in which the amorphous phase can be formed when processed by the method of water quenching a quartz tube with 0.5 mm thick wall containing a molten alloy. In various instances thorughout the disclosure, the metallic glass can be a BMG.

Metallic glasses solidify and cool at relatively slow rates, and they retain the amorphous, non-crystalline (i.e., glassy) state at room temperature. However, if the cooling rate is not sufficiently high or nucleation sources are present, crystals may form inside the alloy during cooling, so that the benefits of the amorphous state can be lost. For example, partial crystallization of parts intended to be formed of metallic glass materials due to either slow cooling or impurities in the raw alloy material results in loss of amorphous character, and hence failure to form a metallic glass. As such, there is a need to develop methods for casting metallic glass-containing parts having reduced or no crystallinity.

Figure 1A:
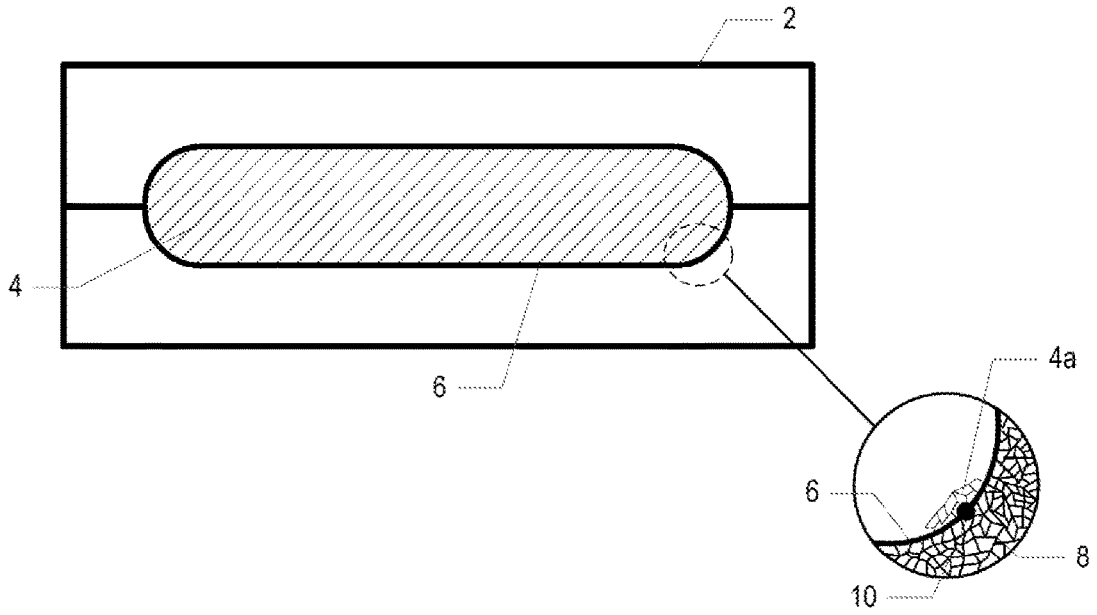
FIG. 1A shows an uncoated mold with a crystallizing metallic glass-containing part.

Metallic glasses can be inherently difficult to mold and solidify in the amorphous state before crystallization begins. One additional factor that can accelerate or exacerbate onset of crystallization is the grain structure of the mold being used. Without intending to be limited by theory, the grain structure of the mold may act as a nucleation point for BMG crystallization. This may be more significant for certain types of metallic glass alloys as compared to others, e.g., platinum-based alloys. For instance, with Pt-based alloys, the onset of nucleation quickly spreads throughout the rest of the alloy, quickly rendering a solidified molded part almost entirely crystalline. For instance, as shown in FIG. 1A, a mold 2 with an uncoated/non-amorphous surface 6 used to form a metallic glass-containing part 4 can form a crystalline grain structure 8 at nucleation site 10 and crystallization 4*a* of metallic glass-containing part 4.

Figure 1B:
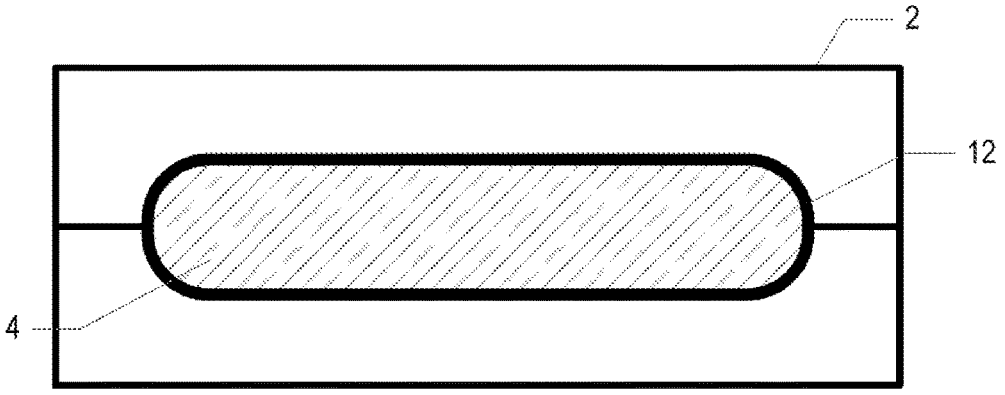
FIG. 1B shows an exemplary amorphous coated mold of the disclosure.

Embodiments herein relate to methods and apparatuses for casting of metallic glass-containing parts. In the present disclosure, the surfaces of the mold that are in contact with the molten amorphous alloy comprise an amorphous material. In some aspects, the mold is coated with the amorphous material. Without intending to be limited by theory, the surfaces of the mold can be coated with the amorphous material to reduce or eliminate potential grain-boundary nucleation sites for metallic glass crystallization. For instance, as shown in FIG. 1B, a mold 2 may be coated with an amorphous coating 12, so as to reduce, minimize, or eliminate crystallization of the cast metallic glass-containing part 4.

In accordance with the disclosure, the mold comprises an amorphous material at the mold surface, e.g., to reduce, minimize, or eliminate crystallization of the molded BMG-containing part. The amorphous material may be an amorphous coating on the surface of a mold. Further, the amorphous material may be any amorphous material known in the art. Exemplary amorphous coatings include: diamond-like carbon (DLC), electroless nickel, electroless nickel-phosphorus (EN), silicon dioxide, silicon carbide, silicon nitride, silicon carbonitride, boron carbide, amorphous alumina, amorphous BMG-containing materials, etc. By way of example, the EN coating includes greater than 10.5% P content, and optionally may comprise boron nitride or Teflon® (polytetrafluoroethylene (PTFE)), e.g., to minimize mold wear and facilitate part. The amorphous material may be selected based on the particular molten amorphous alloy to be cast, e.g., based on the wetting properties, the melting and cooling properties, etc.

The mold may take any suitable size and shape based on, for example, the size and shape of the final metallic glass-containing part. The mold may be formed from any suitable material known to those of skill in the art. For example, the mold may be formed from metals such as metallic glasses, copper, beryllium copper (BeCu), tool steel, or other suitable known metals for such purposes.

Any suitable method for forming the amorphous surface or applying the amorphous coating onto the surface of the mold may be utilized. The method for application may be selected, e.g., based on the amorphous material, mold material, conditions of use, duration of use, etc. By way of non-limiting example, physical vapor deposition (PVD) methods, chemical vapor deposition (CVD) methods, cold-spray application methods, electroless plating methods, etc. For instance, in certain embodiments, amorphous BMG-containing coatings may be applied via cold-spray of BMG powder application, silicon dioxide coatings may be applied via PVD methods, and amorphous alumina coatings may be applied via CVD methods such as plasma enhanced CVD.

As mentioned above, the methods and apparatuses of the disclosure are particularly suited for use in connection with certain molten amorphous alloys such as those prone to quick nucleation and crystallization. While the disclosure is not so limited and can be used in connection with any molten amorphous alloy as discussed herein, in certain aspects the methods and apparatuses are suited for use in connection with platinum-based alloys. Although any of the amorphous materials described herein may be used, in certain embodiments particular amorphous materials for use in connection with platinum-based alloys include: electroless nickel, electroless nickel-phosphorous (EN), and amorphous alumina. Again, by way of example, the EN coating may comprise greater than 10.5% P content, and optionally may comprise boron nitride or Teflon® (polytetrafluoroethylene (PTFE)), e.g., to minimize mold wear and facilitate part.

In certain embodiments, platinum-based alloys, such as Pt—Cu—Ni—Al alloys, do not wet alumina very strongly (e.g., a constant 140 degree wetting angle). While not intending to be limited, this wetting angle may allow for less interaction between the platinum-based alloy and the amorphous alumina-coated mold, thereby reducing potential for nucleation and crystallization, as well as increasing potential for mold life.

In yet other aspects, certain non-amorphous materials/coatings are within the scope of the disclosure, such as those that provide high thermal conductivity in one crystallographic direction. Exemplary non-amorphous materials/coatings within the scope of the disclosure include: pyrolytic boron nitride and pyrolytic graphite. Without intending to be limited by theory, such non-amorphous materials/coatings may generally allow for the spreading and dissipation of heat, e.g., for thin mold parts that accumulate heat like band slot inserts.

In accordance with the disclosure, the methods and apparatuses may be used with any suitable molding or casting technique known to those of skill in the art, e.g., injection molding, die-casting, counter-gravity casting, etc. The disclosure is not limited to the particular molding or casting method employed. In any suitable configuration, a molten metal alloy material may be transferred to an amorphous coated mold cavity of the disclosure under desired conditions. The transferred molten metal alloy ingot may then cool and solidify under desired conditions, and the solidified part may be removed and further processed. Each of the transfer, cooling, solidification, removal and further processing may be controlled as generally known in the art.

Figure 2:
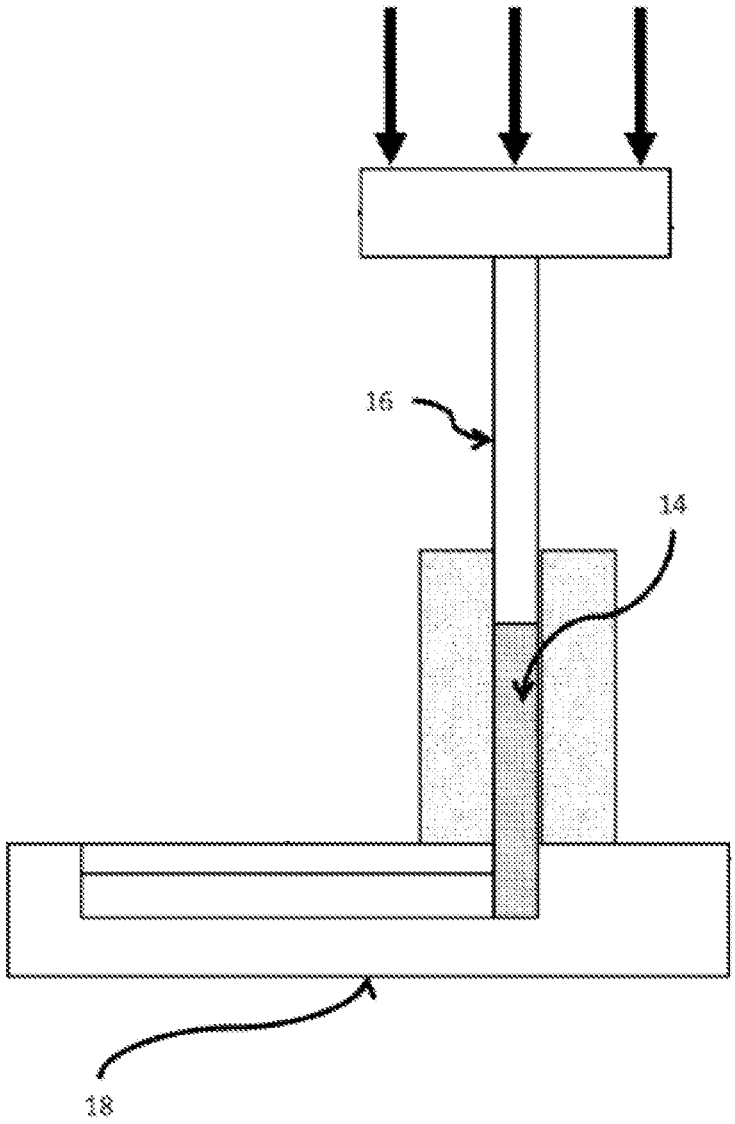
FIG. 2 shows an exemplary method of forming a metallic glass-containing part according to an embodiment of the disclosure.

By way of example, in one embodiment with reference to FIG. 2, injection molding may comprise, injecting molten amorphous alloy 14 into an amorphous coated mold cavity of the disclosure 18, e.g., held at ambient temperature, using a mechanically loaded plunger 16 to form a net shape component of the metallic glass. In an injection molding embodiment, the molten amorphous alloy 14 is charged as a "shot" and may be preloaded to a desired injection pressure (typically 1-100 MPa) by a plunger 16, which then drives the melt 14 into the amorphous coated mold cavity 18.

The formed metallic glass-containing parts may have various three dimensional (3D) structures as desired, including, but not limited to, flaps, teeth, deployable teeth, deployable spikes, flexible spikes, shaped teeth, flexible teeth, anchors, fins, insertable or expandable fins, anchors, screws, ridges, serrations, plates, rods, ingots, discs, balls and/or other similar structures.

Any amorphous alloy in the art may be used in connection with the methods and apparatuses described herein.

The methods and apparatuses described herein can be applicable to any type of suitable amorphous alloy. Similarly, the amorphous alloy described herein as a constituent of a composition or article can be of any type. As recognized by those of skill in the art, amorphous alloys may be selected based on and may have a variety of potentially useful properties. In particular, amorphous alloys tend to be stronger than crystalline alloys of similar chemical composition.

The amorphous alloy can comprise multiple transition metal elements, such as at least two, at least three, at least four, or more, transitional metal elements. The amorphous alloy can also optionally comprise one or more nonmetal elements, such as one, at least two, at least three, at least four, or more, nonmetal elements. A transition metal element can be any of scandium, titanium, vanadium, chromium, manganese, iron, cobalt, nickel, copper, zinc, yttrium, zirconium, niobium, molybdenum, technetium, ruthenium, rhodium, palladium, silver, cadmium, hafnium, tantalum, tungsten, rhenium, osmium, iridium, platinum, gold, mercury, rutherfordium, dubnium, seaborgium, bohrium, hassium, meitnerium, ununnilium, unununium, and ununbium.

In one embodiment, a metallic glass containing a transition metal element can have at least one of Sc, Y, La, Ac, Ti, Zr, Hf, V, Nb, Ta, Cr, Mo, W, Mn, Tc, Re, Fe, Ru, Os, Co, Rh, Ir, Ni, Pd, Pt, Cu, Ag, Au, Zn, Cd, and Hg. Depending on the application, any suitable transitional metal elements, or their combinations, can be used.

Depending on the application, any suitable nonmetal elements, or their combinations, can be used. A nonmetal element can be any element that is found in Groups 13-17 in the Periodic Table. For example, a nonmetal element can be any one of F, Cl, Br, I, At, O, S, Se, Te, Po, N, P, As, Sb, Bi, C, Si, Ge, Sn, Pb, and B. Occasionally, a nonmetal element can also refer to certain metalloids (e.g., B, Si, Ge, As, Sb, Te, and Po) in Groups 13-17. In one embodiment, the nonmetal elements can include B, Si, C, P, or combinations thereof. Accordingly, for example, the alloy can comprise a boride, a carbide, or both.

The amorphous alloy can include any combination of the above elements in its chemical formula or chemical composition. The elements can be present at different weight or volume percentages. Alternatively, in one embodiment, the above-described percentages can be volume percentages, instead of weight percentages. Accordingly, an amorphous alloy can be zirconium-based, titanium-based, platinum-based, palladium-based, gold-based, silver-based, copper-based, iron-based, nickel-based, aluminum-based, molybdenum-based, and the like. The alloy can also be free of any of the aforementioned elements to suit a particular purpose. For example, in some embodiments, the alloy, or the composition including the alloy, can be substantially free of nickel, aluminum, titanium, beryllium, or combinations thereof. In one embodiment, the alloy or the composite is completely free of nickel, aluminum, titanium, beryllium, or combinations thereof.

Furthermore, the amorphous alloy can also be one of the exemplary compositions described in U.S. Patent Application Publication No. 2010/0300148 or 2013/0309121, the contents of which are herein incorporated by reference.

The amorphous alloys can also be ferrous alloys, such as (Fe,Ni,Co) based alloys. Examples of such compositions are disclosed in U.S. Pat. Nos. 6,325,868; 5,288,344; 5,368,659; 5,618,359; and 5,735,975, Inoue et al., Appl. Phys. Lett., Volume 71, p 464 (1997), Shen et al., Mater. Trans., JIM, Volume 42, p 2136 (2001), and Japanese Patent Application No. 200126277 (Pub. No. 2001303218 A). One exemplary composition is $Fe_{72}Al_5Ga_2P_{11}C_6B_4$. Another example is $Fe_{72}Al_7Zr_{10}Mo_5W_2B_{15}$. Another iron-based alloy system that can be used in the coating herein is disclosed in U.S. Patent Application Publication No. 2010/0084052, wherein the amorphous metal contains, for example, manganese (1 to 3 atomic %), yttrium (0.1 to 10 atomic %), and silicon (0.3 to 3.1 atomic %) in the range of composition given in parentheses; and that contains the following elements in the specified range of composition given in parentheses: chromium (15 to 20 atomic %), molybdenum (2 to 15 atomic %), tungsten (1 to 3 atomic %), boron (5 to 16 atomic %), carbon (3 to 16 atomic %), and the balance iron.

The afore described amorphous alloy systems can further include additional elements, such as additional transition metal elements, including Nb, Cr, V, and Co. The additional elements can be present at less than or equal to about 30 wt %, such as less than or equal to about 20 wt %, such as less than or equal to about 10 wt %, such as less than or equal to about 5 wt %. In one embodiment, the additional, optional element is at least one of cobalt, manganese, zirconium, tantalum, niobium, tungsten, yttrium, titanium, vanadium and hafnium to form carbides and further improve wear and corrosion resistance. Further optional elements may include phosphorous, germanium and arsenic, totaling up to about 2%, and preferably less than 1%, to reduce melting point. Otherwise incidental impurities should be less than about 2% and preferably 0.5%.

In some embodiments, a composition having an amorphous alloy can include a small amount of impurities. The impurity elements can be intentionally added to modify the properties of the composition, such as improving the mechanical properties (e.g., hardness, strength, fracture mechanism, etc.) and/or improving the corrosion resistance. Alternatively, the impurities can be present as inevitable, incidental impurities, such as those obtained as a byproduct of processing and manufacturing. The impurities can be less than or equal to about 10 wt %, such as about 5 wt %, such as about 2 wt %, such as about 1 wt %, such as about 0.5 wt %, such as about 0.1 wt %. In some embodiments, these percentages can be volume percentages instead of weight percentages. In one embodiment, the alloy sample/composition consists essentially of the amorphous alloy (with only a small incidental amount of impurities). In another embodiment, the composition includes the amorphous alloy (with no observable trace of impurities).

In various embodiments, the alloy can be any genus or class of metallic glass forming alloy, or specific alloy, described in U.S. patent application Ser. No. 14/667,191, incorporated herein by reference in its entirety.

The methods herein can be valuable in the fabrication of electronic devices using a metallic glass-containing part. An electronic device herein can refer to any electronic device known in the art. For example, it can be a telephone, such as a mobile phone, and a land-line phone, or any communication device, such as a smart phone, including, for example an iPhone®, and an electronic email sending/receiving device. It can be a part of a display, such as a digital display, a TV monitor, an electronic-book reader, a portable web-browser (e.g., iPad®), and a computer monitor. It can also be an entertainment device, including a portable DVD player, conventional DVD player, Blue-Ray disk player, video game console, music player, such as a portable music player (e.g., iPod®), etc. It can also be a part of a device that provides control, such as controlling the streaming of images, videos, sounds (e.g., Apple TV®), or it can be a remote control for an electronic device. It can be a part of a computer or its accessories, such as the hard drive tower housing or casing, laptop housing, laptop keyboard, laptop track pad, desktop keyboard, mouse, and speaker. The article can also be applied to a device such as a watch or a clock.

All publications, patents, and patent applications cited in this Specification are hereby incorporated by reference in their entirety.

While this disclosure has been described with reference to specific embodiments, it will be understood by those skilled in the art that various changes may be made and equivalents may be substituted for elements thereof, without departing from the spirit and scope of the disclosure. In addition, modifications may be made to adapt the teachings of the disclosure to particular situations and materials, without departing from the essential scope thereof. Thus, the disclosure is not limited to the particular examples that are disclosed herein, but encompasses all embodiments falling within the scope of the appended claims.

The invention claimed is:

1. A method of forming a metallic glass, comprising:

placing a softened or molten metallic glass-forming alloy in contact with a coating over a surface of a metal mold, wherein said coating comprises an amorphous material and at least one of boron nitride or polytetrafluoroethylene (PTFE); and cooling the metallic glass-forming alloy to form a metallic glass.

2. The method of claim 1, wherein the coating comprises a material selected from the group consisting of diamond-like carbon (DLC), electroless nickel, electroless nickel-phosphorus (EN), silicon dioxide, silicon carbide, silicon nitride, silicon carbonitride, boron carbide, and amorphous alumina.

3. The method of claim 2, wherein the coating comprises EN.

4. The method of claim 3, wherein the coating comprises greater than 10.5% P content.

5. The method of claim 1, wherein the metallic glass-forming alloy is a platinum-based alloy.

6. The method of claim 5, wherein the platinum-based alloy comprises Pt, Cu, Ni, and Al.

7. The method of claim 1, further comprising shaping the softened or molten metallic glass-forming alloy, wherein the shaping is selected from molding, die-casting, and counter-gravity casting.

8. The method of claim 1, wherein the formed metallic glass is a part for an electronic device.

9. A method of forming a metallic glass, comprising:

placing a softened or molten metallic glass-forming alloy in contact with a coating over a surface of a metal mold, wherein said coating comprises a non-amorphous material comprising at least one of pyrolytic boron nitride and pyrolytic graphite; and cooling the metallic glass-forming alloy to form a metallic glass.

10. The method of claim 9, wherein the metallic glass-forming alloy is a platinum-based alloy.

11. The method of claim 10, wherein the platinum-based alloy comprises Pt, Cu, Ni, and Al.

12. The method of claim 9, further comprising shaping the softened or molten metallic glass-forming alloy, wherein the shaping is selected from molding, die-casting, and counter-gravity casting.

13. The method of claim 9, wherein the formed metallic glass is a part for an electronic device.

14. A mold for forming a metallic glass, comprising:

a metal forming structure; and a coating over a shaping surface of the forming structure, the coating comprising an amorphous material and at least one of boron nitride or polytetrafluoroethylene (PTFE).

15. The mold of claim 14, wherein the coating comprises a material selected from the group consisting of diamond-like carbon (DLC), electroless nickel, electroless nickel-phosphorus (EN), silicon dioxide, silicon carbide, silicon nitride, silicon carbonitride, boron carbide, and amorphous alumina.

16. The mold of claim 15, wherein the coating comprises EN.

17. The mold of claim 16, wherein the coating comprises greater than 10.5% P content.

18. The mold of claim 14, wherein the forming structure comprises a material selected from the group consisting of copper, beryllium copper (BeCu), and tool steel.

19. The method of claim 1, wherein the mold comprises a material selected from the group consisting of copper, beryllium copper (BeCu), and tool steel.

* * * * *